United States Patent [19]

Maschhoff

[11] Patent Number: 4,574,550

[45] Date of Patent: Mar. 11, 1986

[54] BUILDING WALL AND INSULATION ASSEMBLY

[76] Inventor: Jack Maschhoff, P.O. Box 187, Hazel Park, Mich. 48030-0187

[21] Appl. No.: 612,710

[22] Filed: May 21, 1984

[51] Int. Cl.[4] ..... E04B 1/80

[52] U.S. Cl. ..... 52/405; 52/407; 52/309.12

[58] Field of Search ..... 52/309.2, 309.12, 405–407, 52/561, 564

[56] References Cited

U.S. PATENT DOCUMENTS

| | | | |
|---|---|---|---|
| 3,562,991 | 2/1971 | Kustusch | 52/564 |
| 3,788,020 | 1/1974 | Gregori | 52/309.12 |
| 4,336,676 | 6/1982 | Artzer | 52/309.12 |
| 4,433,520 | 2/1984 | Maschhoff | 52/426 |

FOREIGN PATENT DOCUMENTS

| | | | |
|---|---|---|---|
| 288451 | 4/1928 | United Kingdom | 52/564 |
| 2068035 | 8/1981 | United Kingdom | 52/405 |

*Primary Examiner*—James L. Ridgill, Jr.

*Attorney, Agent, or Firm*—Barnes, Kisselle, Raisch, Choate, Whittemore & Hulbert

[57] ABSTRACT

A modular structure for constructing building walls for domestic and commercial housing including inner and outer panels interlocked at the edges by dovetail grooves and retained in spaced relation by wire grills engaged with the edges of the panels. An insulation block is provided, to span a single panel or multiple panels, and positioned against the inside surface of an inner or outer panel. This block is located by individual rods of the wire grills and retained in position by said rods. Multiple blocks, face to face, can be utilized to increase the insulation factor as desired.

2 Claims, 5 Drawing Figures

40
42
44
46
24
50
52
54
20
22
34
32
30

BUILDING WALL AND INSULATION ASSEMBLY

FIELD OF INVENTION

Building walls constructed with identical modular panel elements constrained by metal grills in a spaced relation.

BACKGROUND OF INVENTION

There have been many attempts to reduce the cost of construction of homes and similar structures both as respects cost of materials and cost of labor. In a U.S. Pat. No. 3,562,991, to Kustusch, issued Feb. 16, 1971, there is disclosed a self-supporting building structure utilizing module panels for inner and outer panels horizontally spaced by rigid spacer means and vertically stacked to create a structural load bearing wall. Another patent directed to a similar wall construction, and especially the corner structure, has issued to Maschhoff, U.S. Pat. No. 4,433,520, dated Feb. 28, 1984.

In connection with all structures, the problem of energy conservation has become critical. Heat loss in the cold weather and cooling in the hot weather are problems which are facing all designers of domestic or commercial buildings.

The present invention is directed to an assembly in connection with modular construction which will provide effective insulation for spaced wall construction utilizing the hollow wall adaptation or the filled wall wherein standard or lightweight aggregates are used.

It is an object to provide insulation panels which are compatible in size with the modular elements used in the wall construction and which are retained in position by the spacer restraining elements or grills utilized in the basic wall construction.

It is a further object to provide light easily handled panels which can be installed manually with no adhesions and no special hardware or nailing. A further object is the provision of an insulation assembly which can be applied with equal facility on the inside or outside panels depending on the special requirements of the structure in question.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

The disclosures of the above-referenced U.S. Pat. No. 3,562,991, to Kustusch, and Maschhoff, U.S. Pat. No. 4,433,520, are incorporated herein by reference. These patents disclose a spaced panel wall constructed of pre-dimensioned modules constrained in spaced relation by wire grills which have ends to engage pre-drilled holes in the modules.

Figure 1:
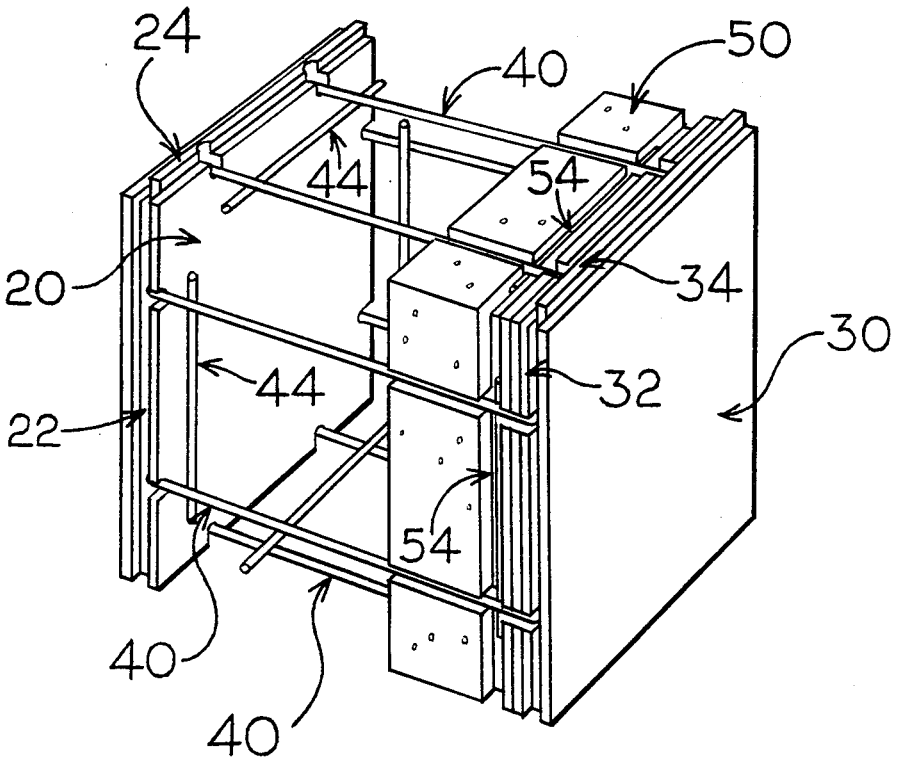
FIG. 1, a perspective view of a single module assembly showing the respective parts.
Figure 5:
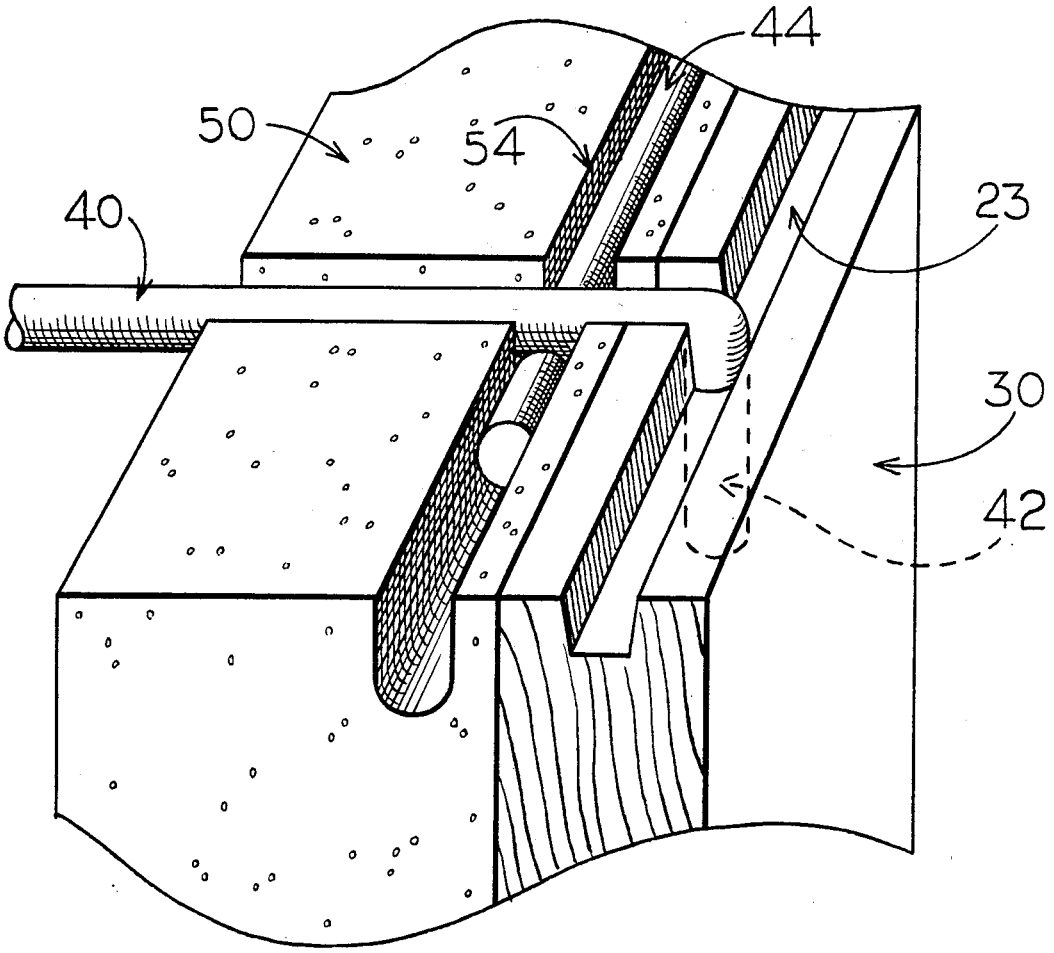
FIG. 5, an enlarged perspective view of the part interlock of the assembled module.

As shown in FIG. 1, a panel 20, which can be either an inside panel or an outside panel, has a side groove 22 and a bottom groove 23 shown in FIG. 5. A tongue 24 formed on the top edge will interfit with the bottom groove of a similar panel. A side tongue on the far edge of panel 20 not visible in the drawing will interfit with a side groove 22 in a similar side panel. A second panel 30 spaced from panel 20 has also a side groove 32 and a tongue 34. Thus, these panels will interlock at each edge in a tongue and groove connection.

Figure 2:
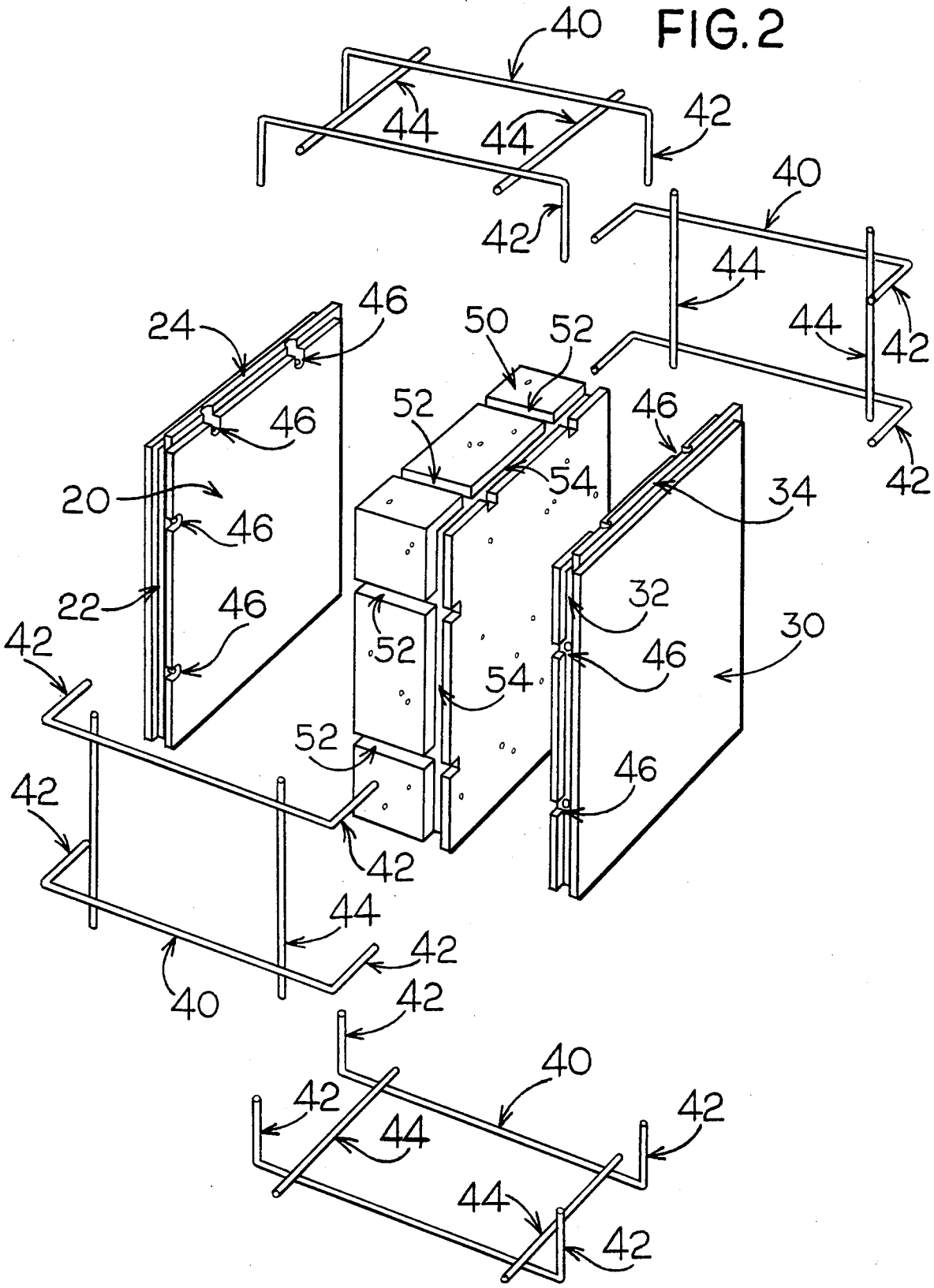
FIG. 2, an exploded view of the parts assembled in FIG. 1.

The panels are constrained in spaced relation by drills 40 formed of wires or rods with bent ends 42 to insert into pre-drilled holes in the panels. The elements of the assembly are best shown in FIG. 2. Each grill is formed of parallel elements held in spaced relation by cross-rods 44 which in each case are located on the same side of the parallel rods as the legs 42. It will be noted that the edges of the panels are notched at 46 to receive the grills which will countersink in a manner not to interfere with the tongue and groove connections between the panels.

Also illustrated in FIGS. 1 and 2 is an insulation block 50 formed of a cellular material such as styrofoam which is available from Dow Chemical Co. of Midland, Michigan.

This block 50 has a dimension substantially equal to the panels 20 and 30 and each edge is cross-notched at 52 to receive the parallel rods of the grills 40. Spaced from one side of the block which is to lie along side a structural panel are edge grooves 54. These grooves receive the cross-rods 44 of the grills 40. The edge grooves 54 and the cross-rods are positioned such that the insulation block 50 will be held snugly against the panel to which it is adjacent, in this example, panel 30.

The panel could equally well be positioned against the inner surface of panel 20.

In FIG. 5, an enlarged view of the panel grill detail is illustrated but from the point of view of the bottom of panel 30 where the groove 23 is shown. This view shows how the cross-rods 44 fit into the groove 54 in the insulation block to hold the block against the panel 30.

Figure 3:
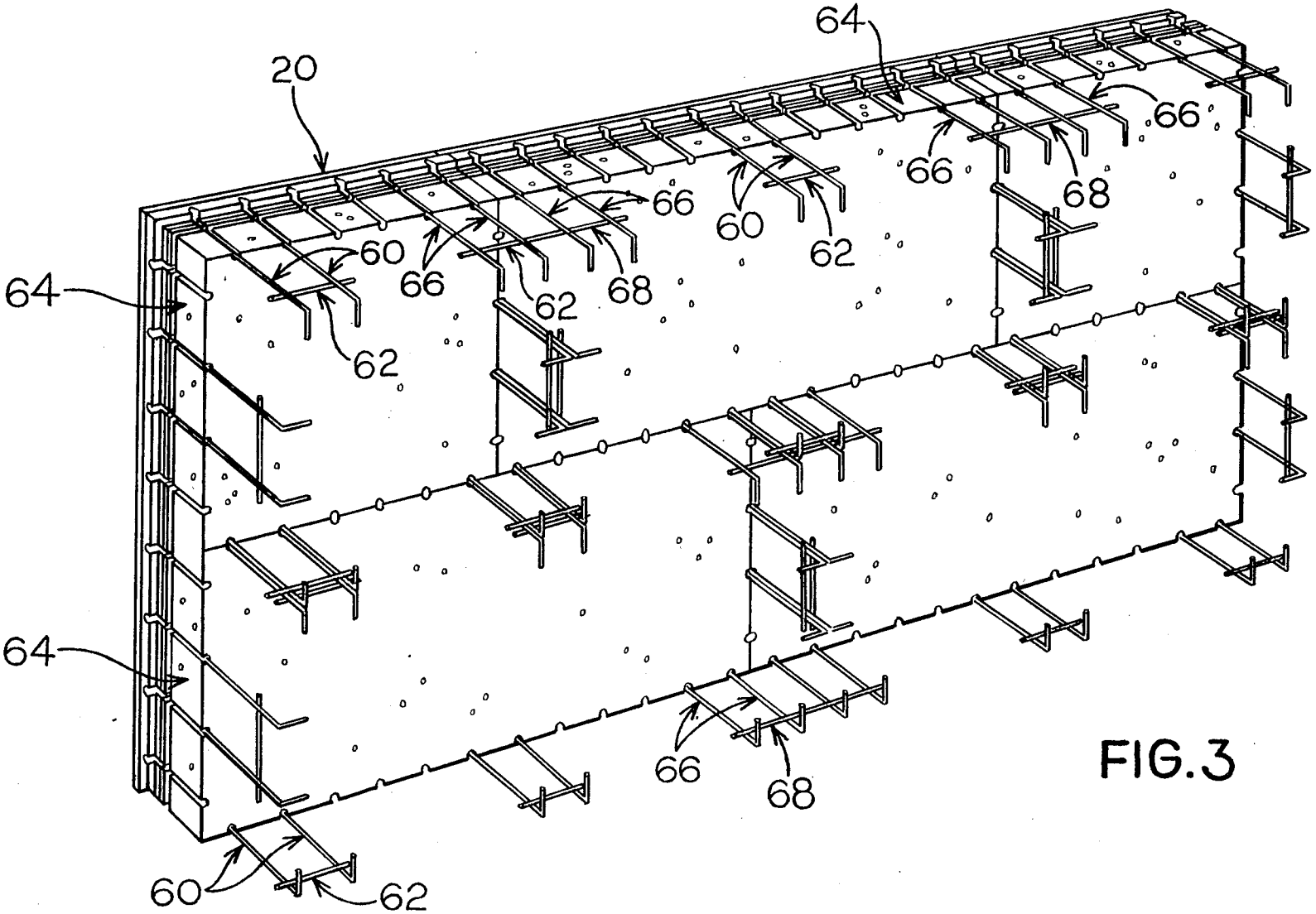
FIG. 3, a perspective view of a multiple module assembly with one side removed to show the respective parts.
Figure 4:
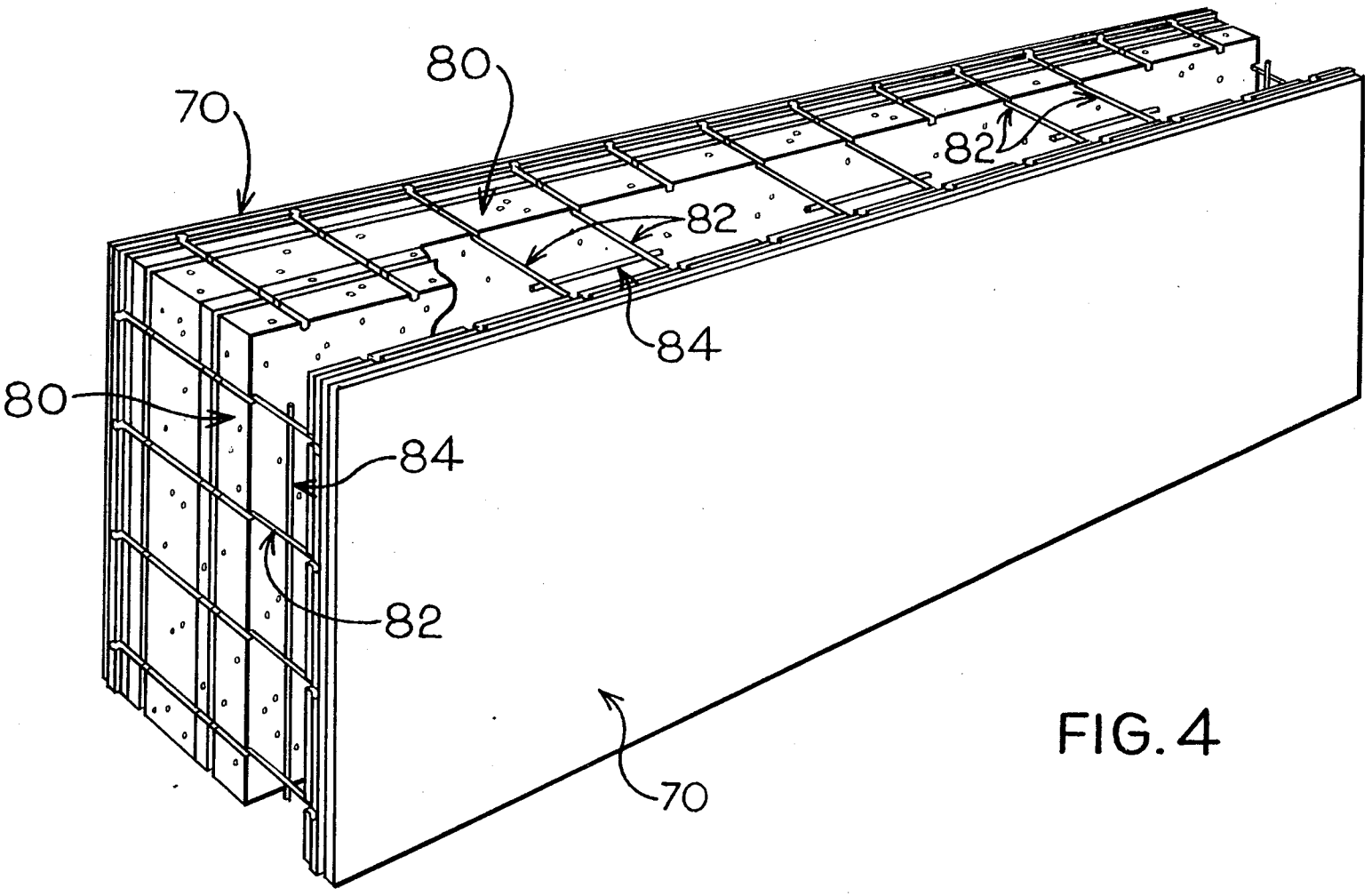
FIG. 4, a view similar to FIG. 3 with both side panels assembled.

FIGS. 3 and 4 illustrate a multiple module assembly in which the insulation is placed against the left-hand panels. In these assemblies a modified grill has, at the top of the figures, a pair of retainer rods 60 with the cross-rods 62 which will engage the groove in the insulation blocks 64. Grills adjacent the joints between the panels may consist of four rods 66 joined by a longer cross-rod 68. In each case, the insulation panel or block is retained by the cross-rods.

An important feature of the present invention is that the recessing of the rods which form the grills allows the insulation panels to be butted tightly at the sides and ends. This results in an unbroken wall of contiguous insulation blocks with no empty space between the insulation blocks. This is clearly illustrated in FIG. 3.

In FIG. 4, larger panels 70 and comparable insulation blocks 80 are utilized with suitable grills with spanning rods 82 and cross-rods 84. Thus, if desired, the insulation blocks can have the same dimension as the panel modules. The size of the insulation blocks will depend on the handling problems and shipping requirements. Panels 4'×8' or 4'×12' could be utilized with comparable insulation blocks.

It will be appreciated that in addition to the insulation block being positionable on either the inner surface of the inner wall or outer wall of a structure, the space remaining between the walls may be filled with standard concrete or a lightweight concrete.

It will be appreciated that double or triple thicknesses of the insulation blocks could be used. The cross-rods have a frictional engagement with the grooves in the insulation blocks which will maintain the blocks in the transverse position in which they are placed. In some localities, it might be desirable to utilize a single thickness in the manner of 2" thick blocks on the east, west, and south walls of a building while a double thickness, e.g., 4" could be used on an exposed north wall. Other multiple combinations could be utilized as required by the circumstances of the structure. Thus, there is considerable flexibility in the use of the insulation blocks.

If multiple thicknesses are utilized, the fill would press the layers together to supplement the frictional engagement of the cross rods.

What is claimed is:

1. In combination, a modular structure composed of spaced parallel panels which are assembled in situ with rigid rod grids spanning the space between said panels interlocked with the edges of the panels and recessed and lying within the planar geometric confines of said panels, and preformed insulation lodging against an inner surface of a least one of said panels in said space comprising a form sustaining block of insulation dimensioned and conforming to the planar dimensions of said panels and having edge grooves transverse to the planes of said panels and receiving portions of said rigid rod grids and positioning block against said one of said panels.

2. A combination as in claim 1 in which said insulation block has edge grooves parallel to the planes of said panels and receiving the rigid rods on said grid extending parallel to the planes of said panel.

* * * * *

UNITED STATES PATENT AND TRADEMARK OFFICE

CERTIFICATE OF CORRECTION

PATENT NO. : 4,574,550

DATED : March 11, 1986

INVENTOR(S) : Jack Maschhoff

It is certified that error appears in the above-identified patent and that said Letters Patent are hereby corrected as shown below:

Col. 4, Line 13, change "a" to -- at --.

Col. 4, Line 18, after "positioning" insert -- the --.

Signed and Sealed this

*Eighth* Day of *July 1986*

[SEAL]

*Attest:*

DONALD J. QUIGG

*Attesting Officer*

*Commissioner of Patents and Trademarks*